United States Patent [19]

Molitor et al.

[11] Patent Number: 4,867,709

[45] Date of Patent: Sep. 19, 1989

[54] CINCH PLUG

[75] Inventors: Paul-Rainer Molitor, Muehldorf a. Inn; Bernhard Neumann, Waldkraiburg; Meinrad Jankowski, Toeging a. Inn, all of Fed. Rep. of Germany

[73] Assignee: Otto Dunkel GmbH, Muehldorf, Fed. Rep. of Germany

[21] Appl. No.: 171,125

[22] Filed: Mar. 21, 1988

[30] Foreign Application Priority Data

Dec. 8, 1987 [DE] Fed. Rep. of Germany ..... 8716204

[51] Int. Cl.[4] ..... H01R 17/04

[52] U.S. Cl. ..... 439/675; 439/578; 439/825; 439/843

[58] Field of Search ..... 439/733, 741, 720, 842–844, 439/846–848, 851–853, 856, 857, 821, 607–610, 578, 585, 675, 825, 826

[56] References Cited

U.S. PATENT DOCUMENTS

| | | | |
|---|---|---|---|
| 3,768,063 | 10/1973 | Coffman | 439/578 |
| 4,326,769 | 4/1982 | Dorsey et al. | 439/578 |
| 4,572,606 | 2/1986 | Neumann et al. | 459/851 |
| 4,720,157 | 1/1988 | Nestor et al. | 439/851 |

FOREIGN PATENT DOCUMENTS

| | | | |
|---|---|---|---|
| 669220 | 12/1938 | Fed. Rep. of Germany | 439/825 |
| 2502632 | 7/1976 | Fed. Rep. of Germany | 439/825 |
| 0450271 | 2/1974 | U.S.S.R. | 439/851 |
| 0803055 | 2/1981 | U.S.S.R. | 439/851 |
| 1092625 | 5/1984 | U.S.S.R. | 439/825 |

*Primary Examiner*—David Pirlot

*Attorney, Agent, or Firm*—Fleit, Jacobson, Cohn, Price, Holman & Stern

[57] ABSTRACT

A cinch plug for connection to an electrical cable in audio or video systems has a contact pin and surrounding contact bushing each of which are formed of curved circumferentially disposed axially extending contact springs.

5 Claims, 1 Drawing Sheet

CINCH PLUG

BACKGROUND OF THE INVENTION

The invention relates to a cinch plug for connection at one end of an electrical cable for signal transmission between individual components of an audio or video installation. The subject plug has a central contact pin and a coaxial contact bushing.

In known cinch plugs of this type, the contact pin is commonly solid, and the contact bushing is comprised of simple contact plates with intervening gaps. In practice, particularly where frequent plugging and unplugging are required (e.g., in test situations), the contact resistances may become excessive, leading to interference with signal transmission and incorrect test results. Also, the force required to insert the plug into and remove it from sockets on the apparatus is substantial, which is a burden when the plug is used in testing work, and often when handled roughly by a layman will lead to damage to equipment or plugs.

SUMMARY OF THE INVENTION

An object of the invention is therefore to refine the cinch plug of the type described, whereby plugging and unplugging becomes simple and convenient, while the contact resistance is minimal.

A cinch plug which, in accordance with the invention effectively fulfills the above object is characterized in that the contact pin and/or the contact bushing comprises a plurality of circumferentially disposed contact springs. Thus, the invention is based on the recognition that the properties of known spring-wire contacts may be exploited in a cinch plug, with complete compatibility with systems already on the market so that the invention can be effectively introduced into existing systems.

Particularly favorable plugging conditions, such as low plug-in force, low contact resistance, and long service life are provided if both the contact pin and the contact bushing are formed by circumferentially disposed contact springs.

It has further been found to be advantageous, from a manufacturing standpoint, if the contact bushing has a bushing holder in the form of a cylinder, with its inner end closed, (but penetrated centrally by the contact pin), and its outer end open, and a contact ring carrying the contact spring is inserted into the cylinder from the open end and fixed therein. In an advantageous refinement, the contact ring may be held in place by bending the outer edge of the bushing holder inwardly.

Further manufacturing advantage is obtained if the contact springs of the contact bushing are interconnected at their respective ends by respective metal strips, whereby the mutual spacing of the springs is maintained; and further if, when in an initial flat configuration of the springs and metal strips, the contact springs are curved out of a common plane containing the springs and metal strips, whereby the distance between the metal strips is reduced. Preferably, the entire unit comprised of the contact springs and metal strips may be roll-formed around an axis which is on the side toward which the contact springs are curved, such that a ring-shaped contact structure, or contact ring, is formed.

In order to provide a particularly simple means of fixing the central contact pin within the housing, it is advantageous if the central contact pin has a mounting base which holds the contact springs in place in a sprung state, and which is itself held in an insulating body; and if the insulating body is fixed in the central bore of the bushing holder. The plug may be comprised, in known fashion, of a plurality of contact spring wire segments, one end of which wire segment is clamped in a copper sleeve by radial rolling, crimping, or the like, in combination with a central projection of a plug pin support. Manufacturing advantage is obtained if the contact springs of the contact pin, analogously to the contact springs of the contact bushing, are connected to form a unit comprised of said springs and metal strips, and wherein the unit is converted to the form of the contact pin by roll-forming around an axis which is on the side of the unit which is away from the side toward which the contact springs curve.

A means for joining the contact spring segments to the connecting metal strips to form the aforesaid units comprised of springs and metal strips may, for example, be, soldering.

However, further manufacturing advantage is obtained if the contact springs and the metal strips joining them are fabricated as a single unit stamped from a sheet of contact spring material.

It is also advantageous, for fixing the contact pin in the central bore of the cylindrical bushing-holder, if the insulating body is comprised of two parts which together delimit a space shaped specifically for receiving the mounting base, wherein the base is surrounded by (or enclosed between) the insulating body parts. It is further advantageous if the plane of separation of the insulating body is transverse to the axis of the insulating body.

In order to achieve accurate central orientation and fixing of the contact pin in the cylindrical bushing-holder, it is advantageous if the central bore of the bushing holder has a shoulder against which a corresponding shoulder on the insulating body can be lodged.

It is also advantageous if the cylindrical bushing-holder has a tubular extension on its face remote from its open end, wherein the inner diameter of the extension matches the outer diameter of the insulating body, and the length of the extension is such that its free end can be bent to hold the insulating body, at the end of the insulating body remote from the contact pin.

Advantageously the tubular extension of the bushing holder has outer threads which match inner threads on the plug housing, whereby the housing may be screwed onto the bushing holder.

Further, the plug housing may advantageously have an inner thread at its end remote from the bushing holder, whereby a tension relief part can be screwed in.

In an advantageous refinement of the cinch plug, the cylindrical bushing-holder and plug housing together may have a unitary construction, and the insulating body which surrounds the central contact pin may be long enough such that, after the tension relief part is screwed into the inner thread of the plug housing, the thrust shoulder of the insulating body is held against an opposing thrust shoulder of the central bore.

Additional details, advantges, and features of the invention will be evident from the following description with reference to the drawings. All details in the drawings not specifically described in the text are expressly incorporated herein by reference, for purposes of disclosure.

DESCRIPTION OF PREFERRED EMBODIMENTS

Figure 1:
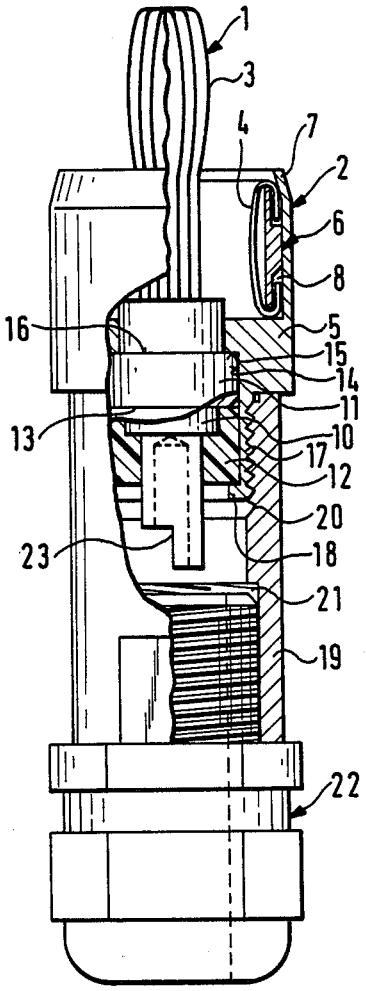
FIG. 1 is a longitudinal cross section through a first embodiment cinch plug.

As seen from the drawings, in which like references refer to like parts throughout, the illustrated cinch plug is comprised of a central contact pin 1 and a contact bushing 2 coaxial therewith. The contact pin 1 projects about 6–8 mm forwardly of the contact bushing 2, in order to ensure that the pin 1 is plugged in first. In the embodiments illustrated, the contact pin 1 and contact bushing 2 each have a plurality of circumferentially disposed contact springs 3, 4. The contact springs 3 are curved outwardly as shown, whereby the zenith of their curvature is disposed in the forward region of the contact pin, which projects beyond the contact bushing, thereby contributing to an early holding point.

The contact bushing 2 is comprised of a bushing holder 5 in the form of a cylinder with the inner end closed (but penetrated by the contact pin 1 in the center). A contact ring 6 carrying the contact springs 4 can be inserted into holder 5 from the free outer end of the holder. The ring 6 is held in place by radial inward bending or crimping of the outer edge 7 of the bushing holder 5. In the embodiments shown in FIGS. 1 and 2, the contact ring 6 has a rectangular cross section, with two outside recesses 8 at the ends, to accommodate the ends of the contact springs 4. The spring ends are thus directed toward each other.

It is relatively cumbersome to assemble a contact bushing with a contact ring 6 which generally loosely carries the contact springs 4. Thus it is possible, as shown schematically in FIG. 3, for the respective ends of the contact springs 4 to be joined by metal strips 9, which strips serve to maintain a predetermined mutual distance between springs 4. Thus there is provided a single unit comprising the contact springs and metal strips. The unit may be initially formed as a planar grid. The contact springs 4 in this unit are curved out of the common plane of the metal strips 9, which reduces the distance between the strips. Then the entire unit is roll-formed around an axis which is on the side toward which the contact springs are curved. The result is the contact ring 6. It is seen from FIG. 3 that the roll-forming of the unit to form the ring 6 causes the curved regions of the contact springs 4 to be closer together than their ends.

Figure 3:
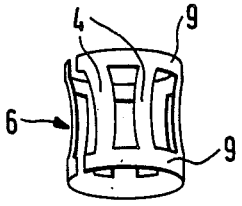
FIG. 3 is a perspective view of a contact ring which may be advantageously used in the cinch plugs.

In practice the number of contact springs 4 may be much greater than illustrated; and all the springs are interconnected by the metal strips 9 as shown in FIG. 3.

Analogously, the ends of the contact springs 3 of the contact pin 1 may also be interconnected by metal strips, which interconnection serves to maintain a predetermined spring spacing. The spring-and-strip unit here may also initially be planar. The contact springs of the unit may also be permanently curved out of the common plane of the two metal strips, which reduces the distance between the strips. Then the entire unit may be roll-formed around an axis which is on the side away from the side toward which the contact springs are curved. The result is a contact pin form.

In either the production of a contact bushing or of a contact pin, the unit comprising the contact springs and the metal strips may be fabricated by stamping from a sheet of contact spring material. This obviates the need to separately join the ends of the contact springs to the metal strips, such as by soldering or the like.

The central contact pin 1 comprises a mounting base 10 which holds the contact springs 3 in a sprung state. The base 10 is accommodated in an insulating body comprised of two parts 11, 12, preferably comprised of PTFE (polytetrafluoroethylene). The plane of separation between the parts 11 and 12 is transverse to the axis of the insulating body. The two insulating body parts 11, 12 together define a recess complimentary to the shape of the base 10, and they enclose the base 10 between them, i.e., they surround and cover the base 10.

The central bore of the bushing holder 5 has a shoulder 15 against which the insulating body 11 is held in place via its own shoulder 16.

In the embodiment illustrated in FIG. 1, the bushing holder 5 has a tubular extension 17 on its inner end. The inner diameter of extension 17 matches the outer diameter of the insulating body 11, 12, and it is long enough so that its free edge 18 can be bent inward to hold the inner end of the insulating body 11, 12. This bending effectively fixes the contact pin 1 with respect to the bushing holder 5.

The tubular extension 17 on the bushing holder 5 has an outer thread, and the plug housing 19 has a matching inner thread 20 which screws onto extension 17. A suitable inner thread 21 on the other end of plug housing 19 receives a known type of tension relief part 22. The structure of part 22 will not be described in detail here, since it is well-known. The outer shielding of a coaxial cable (not shown) can be fixed in part 22, whereby the plug housing when screwed in provides an electrical connection to the contact bushing 2. The central conductor of the coaxial cable may be affixed in advance to a soldering cup 23 of the contact pin 1.

Figure 2:
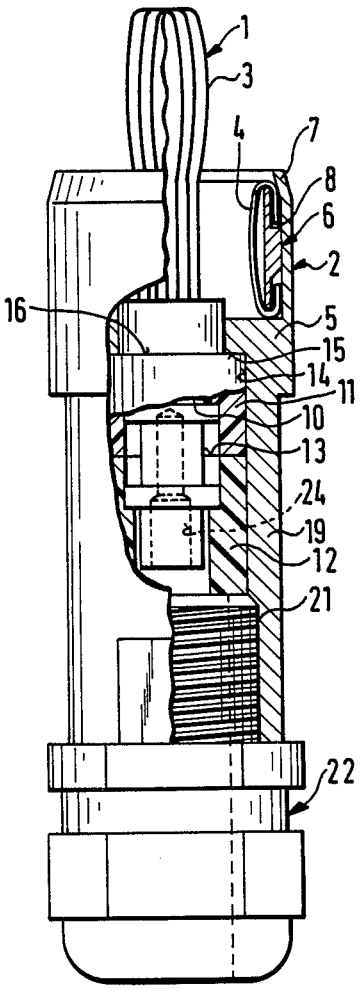
FIG. 2 is a longitudinal cross section through a second embodiment cinch plug.

In the embodiment illustrated in FIG. 2, the bushing holder 5, which again is in the form of a cylinder with one end closed, is of unitary construction with the plug housing 19. The insulating body 11, 12 which surrounds the central contact pin 1 has a length such that after the tension relief part 22 is screwed into the inner thread 21 of the plug housing 19 it holds a thrust shoulder 16 of the insulating body 11, 12 against the shoulder 15 of the central bore 14. In this embodiment also, the central conductor of a coaxial cable can be connected to the central contact pin 1, for example by soldering in the region of the bore 24.

We claim:

1. A cinch plug for connection at one end of an electrical cable for signal transmission between individual components of an audio or video installation, said plug having a housing with a central contact pin and a coaxial contact bushing surrounding the contact pin; characterized in that the contact pin and the contact bushing each comprise a plurality of circumferentially disposed axially extending springs, with the springs of the pin being bowed outwardly and the springs on the bushing being bowed inwardly;

wherein the contact bushing has a bushing holder in the form of a cylinder with a closed inner end penetrated centrally by the contact pin, and a contact ring carrying the contact springs forming the contact bushing is inserted into the holder from an outer end thereof and fixed therein, and wherein the contact ring has outer recesses, to accommodate respective ends of the contact springs which ends are directed toward each other.

2. A cinch plug according to claim 1; wherein the springs of the contact bushing are interconnected at their respective ends by metal strips, whereby a mutual spacing of the springs is maintained; wherein the contact springs are curved out of a common plane of the metal strips, whereby the distance between the metal strips is reduced; and wherein a unit comprised of the contact springs and metal strips is roll-formed around an axis which is on the side toward which the contact springs are curved, to provide a ring-shaped contact structure.

3. A cinch plug according to claim 1; wherein the springs of the contact pin are interconnected at their respective ends by metal strips, whereby a mutual spacing of the springs is maintained; wherein the contact springs are curved out of a common plane of the metal strips, whereby the distance between the metal strips is reduced, and wherein an entire unit comprised of the contact springs and metal strips is roll-formed around an axis which is on a side opposite a side toward which the contact springs are curved.

4. A cinch plug according to claim 2; wherein the contact springs of the bushing and the metal strips joining same are as a single unit stamped from a sheet of contact spring material.

5. A cinch plug according to claim 1, wherein the contact pin projects from one end of the housing.

* * * * *